United States Patent [19]

Ariyama et al.

[11] 4,056,315

[45] Nov. 1, 1977

[54] SQUEEZE ROLLER RETRACTION ASSEMBLY

[75] Inventors: Kenzo Ariyama; Sakae Ota, both of Tokyo; Sunao Ikeda; Toyoo Okamoto, both of Yokohama, all of Japan

[73] Assignee: Ricoh Company, Ltd., Japan

[21] Appl. No.: 647,816

[22] Filed: Jan. 9, 1976

[30] Foreign Application Priority Data

Jan. 14, 1975 Japan ..... 50-6714

[51] Int. Cl.[2] ..... G03G 15/10; G03G 21/00

[52] U.S. Cl. ..... 355/10; 15/256.52; 118/652; 355/15

[58] Field of Search ..... 355/3 R, 3 TR, 3 DR, 355/10, 15; 118/70, 104, 203, DIG. 23, 652; 15/1.5, 256.51, 256.52, 256.53

[56] References Cited

U.S. PATENT DOCUMENTS

| | | | |
|---|---|---|---|
| 3,671,119 | 6/1972 | Engel et al. | 355/3 R |
| 3,689,146 | 9/1972 | Ito et al. | 355/3 R X |
| 3,792,925 | 2/1974 | Milligan et al. | 355/15 |
| 3,907,423 | 9/1975 | Hayashi et al. | 355/10 |

OTHER PUBLICATIONS

Oldenboom; D. J.; "Electromechanical Transfer Mechanism," IBM Technical Disclosure Bulletin, vol. 1, No. 3, Oct. 1958, pp. 4–5.

Davidge et al.; "Force Loaded Cleaning Station" IBM Technical Disclosure Bulletin, vol. 16, No. 4, Sept. 1973, pp. 1265–1266.

*Primary Examiner*—Fred L. Braun

*Attorney, Agent, or Firm*—McGlew and Tuttle

[57] ABSTRACT

A squeeze roller retraction assembly for use with electrophotographic copying machines of the type in which a photosensitive drum is removable from the machine, for inspection or other purposes, through an opening formed in a sidewall which opening is normally covered by a coverplate. A squeeze roller which normally engages with the peripheral drum surface has its engagement therewith automatically released once the coverplate has been dismounted from the sidewall, and also is returned to its operative position as the coverplate is remounted, to thereby prevent damage of the drum as well as a wrong usage of the machine which may be caused by forgetting to replace the squeeze roller to the operative position.

8 Claims, 12 Drawing Figures

SQUEEZE ROLLER RETRACTION ASSEMBLY

BACKGROUND OF THE INVENTION

The invention relates to a squeeze roller retraction assembly, for use with an electrophotographic copying machine of the type in which a latent image is subjected to a wet developing step and the resulting visual image is transferred onto a record sheet, for facilitating the dismounting or mounting of a photosensitive drum from or onto the machine.

In the known copying process in which an electrostatic latent image is formed on the surface of a photosensitive drum and is converted into a visual image with a developing solution and then the visual image is transfered onto a record sheet, the removal of an excess amount of developing solution which wets the surface of the drum before the visual image is transferred onto the record sheet is essential in order to assure a successful transfer. A squeeze roller is usually employed and is effective to remove such excess amount of developing solution. Referring to FIG. 1 for a brief description of the process involved, there is shown a photosensitive member 1 in the form of a drum, and a squeeze roller 2 is disposed closely thereto at a position intermediate a developing station and a transfer station. The roller 2 is shown as mounted on a rotary shaft 20, which is driven at a rotational speed, determined by the peripheral speed of the drum 1, in a direction which is usually opposite from the direction of rotation of the drum, but which may be the same therewith, in order to remove an excess amount of developing solution from the drum surface. The squeeze roller 2 is urged toward the drum surface, and a pair of bearings 21, 22 rotatably disposed on the opposite ends of the squeeze roller 2 function as spacers to maintain a constant spacing, between the surface 23 of the roller and the drum 1, which corresponds to the difference in diameter between the roller surface 23 and the bearings, by abutting against the opposite ends of the drum surface.

When dismounting or mounting the drum 1 from or onto the copying machine, the squeeze roller 2 must be retracted from the drum surface since otherwise the surface of the drum which is displaced axially may be scratched by the bearings 21, 22 which are maintained in abutting engagement therewith to thereby cause damage to the drum surface or to interfere with the dismounting or mounting operation. Heretofore, the squeeze roller has been retracted by a separate operation from the mounting or withdrawal of the drum, with the result that inadvertent errors have been involved in dismounting the drum without retracting the squeeze roller to cause damage to the drum surface, forgetting to replace the squeeze roller to its operative position after the drum has been mounted, thereby wetting the record sheet too much to provide a good copy.

SUMMARY OF THE INVENTION

In view of the foregoing, it is an object of the invention to provide a squeeze roller retraction assembly which provides an automatic retraction of the squeeze roller when the photosensitive drum is dismounted and which provides an automatic replacement of the squeeze roller when the drum has been mounted.

DETAILED DESCRIPTION OF EMBODIMENTS

Figure 1:
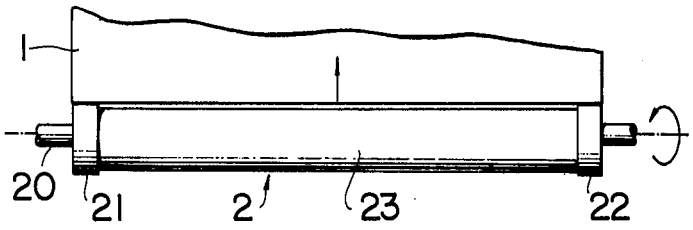
FIG. 1 is a schematic view illustrating the positional relationship between a squeeze roller and a photosensitive drum.
Figure 2:
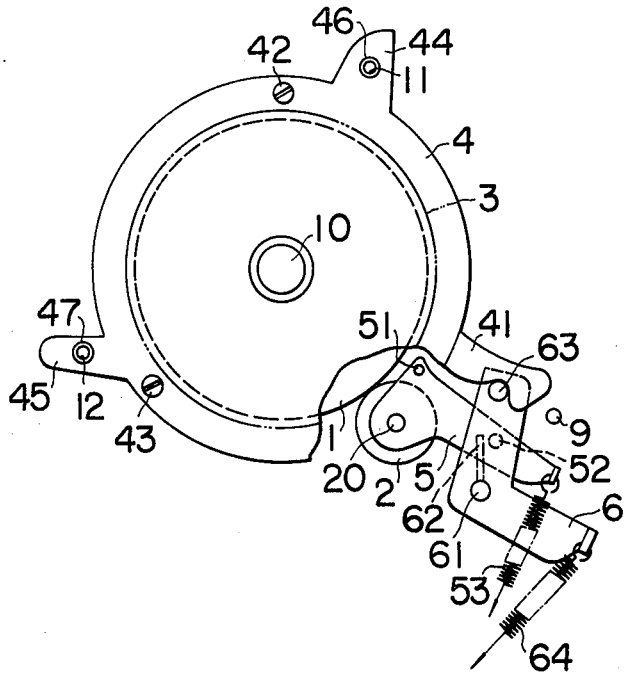
FIG. 2 is a schematic front view of one embodiment of the invention.
Figure 3:
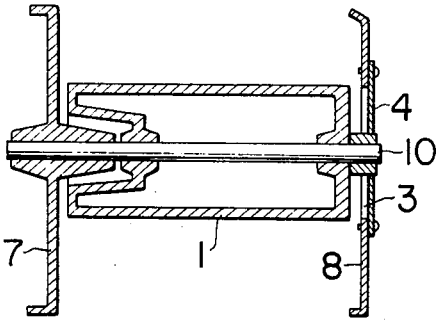
FIG. 3 is an axial section of the photosensitive drum.
Figure 4:
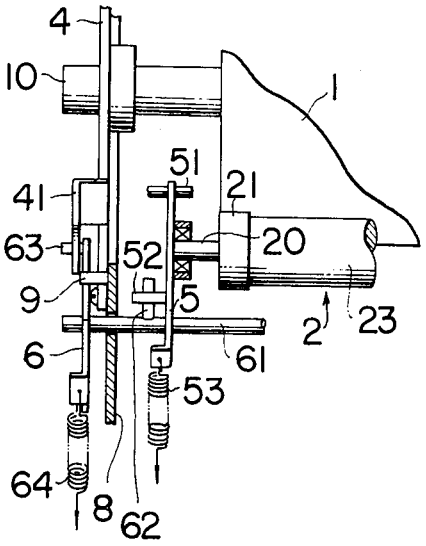
FIG. 4 is a fragmentary side elevation of the embodiment shown in FIG. 2.
Figure 5:
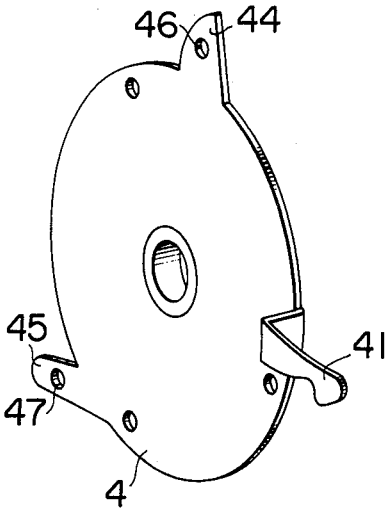
FIG. 5 is a perspective view of the coverplate shown in FIG. 3.

Referring to FIG. 2, there is shown one embodiment of the squeeze roller retraction assembly according to the invention. The assembly includes a coverplate 4 which is mounted to cover an opening 3 formed in the sidewall of the casing of the copying machine so as to permit a passage of the photosensitive drum 1 therethrough. Another sideplate 7 is formed with a bearing, as is the coverplate 4, for supporting a shaft 10 on which the drum 1 is mounted. A support member 5 is pivotally mounted on a stationary pin 51 for journaling the rotary shaft 20 on which the squeeze roller 2 is mounted. A tension spring 53 extends between the free end of the support 5 and a stationary point to bias support 5 for a clockwise rotation, as viewed in FIG. 2. The bias is effective to urge the squeeze roller 2 toward the drum 1, whereby the bearings 21, 22 (shown in FIG. 1) are brought into abutment against the opposite ends of the drum surface. The support member 5 fixedly carries a pin 52 intermediate its length. A release lever 6 is pivotally mounted on a shaft 61, and has its one end engaged by a tension spring 64 the other end of which is anchored to a stationary point, whereby the lever 6 is biased for a clockwise rotation about the shaft 61. As shown in FIG. 4, the shaft 61 extends through the sideplate 8, and a pin 62 is fixedly mounted thereon on the opposite side of the sideplate 8 from the lever 6 for engagement with the pin 52 on the support member 5. At its other end, the release lever 6 fixedly carries a detent pin 63. The coverplate 4 is formed with a detent piece 41, which, as shown in FIG. 5, extends in a plane parallel to, but spaced from the plane of the coverplate 4. The detent pin 63 is engaged by the detent piece 41 to limit the extent of the angular movement of the release lever 6 which takes place under the bias of spring 64 (see FIGS. 2 and 4).

When dismounting the drum 1 from the machine, set screws 42, 43 etc., (see FIG. 2) which secure the coverplate 4 in place, are removed to permit an axial movement of the drum 1 through the opening 3. As the coverplate 4 is removed, the detent pin 63 on the release lever 6 is disengaged from the detent piece 41, whereby the lever 6 rotates clockwise under the bias of the spring 64. Thereupon, the pin 62, which is fixedly mounted on the shaft 61 engages the pin 52. The bias of the spring 64 is so chosen that a sufficient torque is applied to the release lever 6 to cause a counterclockwise rotation of the support member 5 through the engagement between the pins 62, 52 to thereby retract the squeeze roller 2 away from the drum surface. After the squeeze roller 2 is retracted from the drum surface, the drum 1 is axially moved through the opening 3 to the exterior thereof. The squeeze roller 2 is retracted until a clockwise rotation of the release lever 6 is interrupted by its abutment against a pin 9 which is fixedly mounted on the sideplate 8. At this time, the detent pin 63 will assume a position which the detent piece 41 previously occupied.

When replacing the drum 1 into the machine, the procedure is opposite to that described above. To close the opening 3 with the coverplate 4, the coverplate 4 is secured to the sideplate 8 by means of the screws 42, 43, ect., after locating it by fitting locating apertures 46, 47 formed in a pair of projections 44, 45 of the coverplate 4 over a pair of positioning pins 11, 12 which are fixedly mounted on the sideplate 8. In the course of such assembly, the detent pin 63 on the release lever 6 is engaged by the detent piece 41 integral with the coverplate 4 to thereby rotate the lever 6 in the counterclockwise direction. Thus, the coverplate 4 cannot be secured to the sideplate 8 unless the detent pin 63 is engaged by the detent piece 41. When the coverplate 4 is secured to the sideplate 8 in this manner, the torque applied to the release lever 6 is no longer transmitted to the support member 5, which is therefore allowed to rotate clockwise under the bias of the spring 53 to bring the squeeze roller 2 into its operative position again. Thus the engagement and release of the lever 6 with or from the detent piece 41 of the coverplate 4 is automatically achieved when dismounting or mounting the drum 1, thereby eliminating the disadvantages mentioned above.

Figure 6:
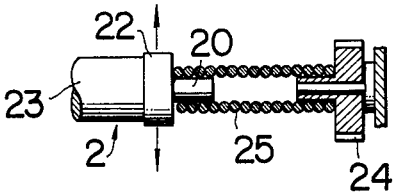
FIG. 6 is a side elevation, partly in section, of a mechanism which transmits a drive to the squeeze roller.
Figure 7:
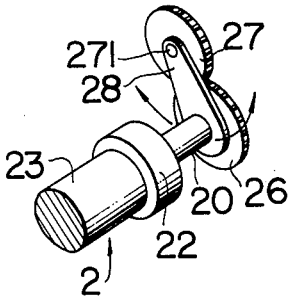
FIG. 7 is a perspective view of another example of the mechanism which transmits a drive to the squeeze roller.
Figure 8:
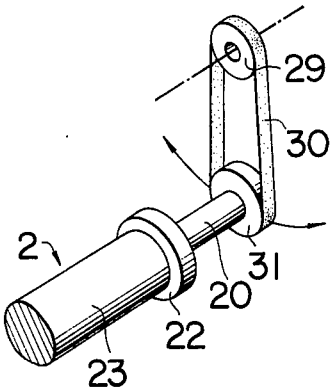
FIG. 8 is a perspective of a further example of the mechanism which transmits a drive to the squeeze roller.
Figure 9:
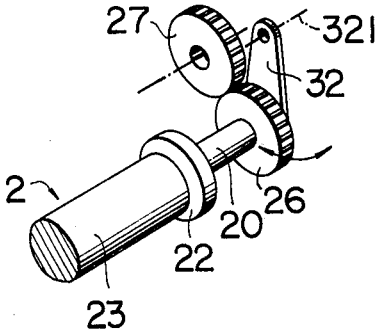
FIG. 9 is a perspective view of an additional example of the mechanism which transmits a drive to the squeeze roller.

With the present retraction assembly, the squeeze roller 2 is displaced as the drum 1 is dismounted or mounted. Since a drive is transmitted to the squeeze roller 2 to rotate it, the transmission mechanism must be capable of allowing such a displacement of the squeeze roller 2. Such a mechanism may comprise a flexible means such as spring 25 shown in FIG. 6 which transmits a drive from a drive gear 24 to the rotary shaft 20. Alternatively, as shown in FIG. 7, the mechanism may comprise a driven gear 26 fixedly mounted on the rotary shaft 20 and meshing with a drive gear 27, the shaft 271 of which rotatably carries a lever 28 on which the shaft 20 is carried, for permitting a displacement of the squeeze roller 2 as the lever 28 rocks. As a further alternative, FIG. 8 shows a drive mechanism comprising a drive pulley 29 and a driven pulley 31 which is fixedly mounted on the rotary shaft 20 and which is driven by the pulley 29 through a transmission belt 30, thus enabling a displacement of the squeeze roller 2. As an additional alternative, FIG. 9 shows a lever 32 carrying the rotary shaft 20 and pivotally mounted on a shaft 321 for rocking motion thereabout so that a displacement of the squeeze roller 2 may be permitted, while moving the driven gear 26 into and out of engagement with the drive gear 27 so that the drive is transmitted to the roller only when the both gears 26, 27 are in meshing engagement with each other.

Figure 10:
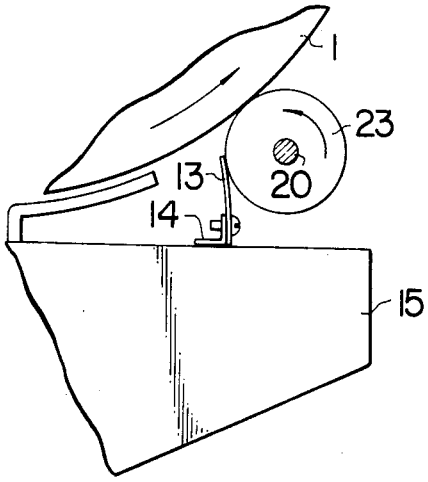
FIG. 10 is a fragmentary front view of the squeeze roller and the blade.
Figure 11:
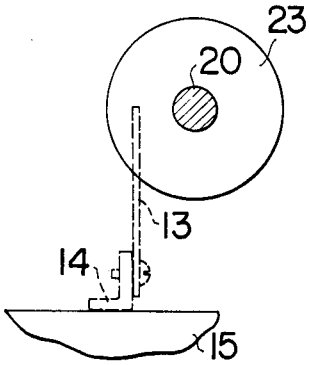
FIG. 11 a schematic view showing the positional relationship between the sequeeze roller and the blade when mounting the latter on the former.
Figure 12:
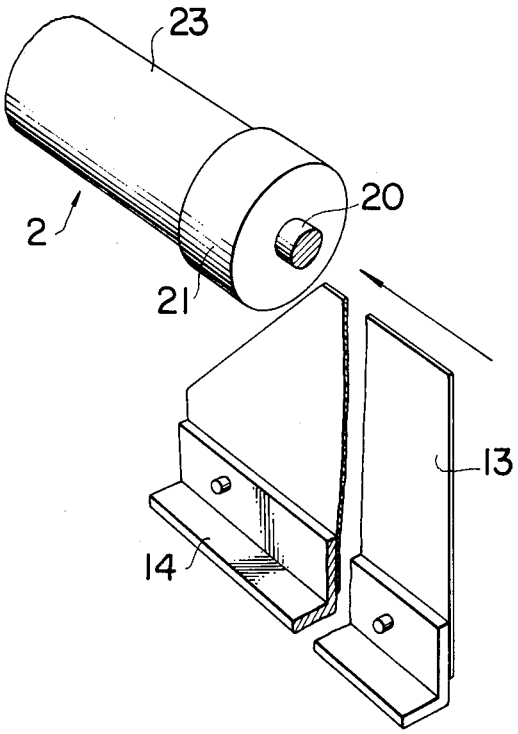
FIG. 12 is a perspective view of a slantwise notched blade which prevents damage or bending thereof when mounting it on the squeeze roller.

As shown in FIG. 10, a blade 13 is maintained in abutment against the periphery of the roller surface 23 of the squeeze roller 2 so as to clean the surface thereof. The blade 13 is a thin sheet of a resilient material such as Mylar film, and is usually fixedly mounted on the tank 15 of the developing unit by means of a support 14. When dismounting and mounting the tank 15 from or onto the machine, the blade is frequently damaged or bent by abutment against the end face of the squeeze roller 2 since it is configured, in its free position, to lie within the space occupied by the squeeze roller 2, as shown in FIG. 11. To prevent damage or bending of the blade 13 by abutment against the end face of the squeeze roller 2 as the tank is either dismounted or mounted, it may be bevelled at its corner which is located nearer the squeeze roller 2 as the tank is mounted, as shown in FIG. 12. When the tank is mounted together with the blade, the bevelled portion of the blade 13 initially engages the edge of the bearing 21, which flexes the blade 13 radially of the roller 2, thus avoiding damage thereto.

What is claimed is:

1. An electrophotographic copying machine comprising, in combination, a phtosensitive drum; a pair of sidewalls for rotatably mounting said drum therebetween; one of said sidewalls having an opening to permit a passage of said drum therethrough; a cover plate detachably mounted on said one sidewall to cover the opening and rotatably mounting a corresponding end of said drum; a squeeze member, normally maintained close to the peripheral surface of said drum, mounted on said sidewalls, for removing an excess amount of a developing solution from the drum surface; and a squeeze member retraction assembly comprising:

a. first lever means swingable about a stationary axis parrallel to the axis of said drum and supporting said squeeze member, b. first spring means connected to said first lever means for urging the squeeze member to be maintained close to said drum surface, c. second lever means having a detent member attached thereto and mounted for movement of said detent member in a plane perpendicular to the drum axis along a predetermined path, d. second spring means connected to said second lever means, e. detent plate means, including a detent portion releasably engageable with said detent member against the bias of said second spring means, mounted on said cover plate and extending over and in the detent member path when the cover plate is mounted on said one side wall, and said detent portion releasing said detent member in response to dismounting of said cover plate from said one side wall, and f. means operable to interconnect said first and second lever means when said detent member is released from said detent portion, whereupon said second spring means overcomes the bias of said first spring means to move said squeeze member away from the drum surface, said detent portion reengaging said detent member in response to remounting of said cover plate on said one sidewall to disconnect said second lever means from said first lever means for movement of said squeeze member close to the drum surface by the bias of said first spring means.

2. An assembly according to claim 1, wherein said second lever means comprises a bell crank.

3. An assembly according to claim 1, wherein said detent member comprises a pin and said detent plate means comprises a protrusion formed integrally with said coverplate and having a recess at one side edge thereof which serves as said detent portion.

4. An assembly according to claim 1, wherein said squeeze member comprises a rotatable roller having a center shaft, a drive source and transmission means connecting said center shaft to said drive source.

5. An assembly according to claim 4, wherein said transmission means comprises a flexible shaft.

6. An assembly according to claim 4, wherein said transmission means comprises a transmission belt trained over a driven pulley connected to said center shaft and over a drive pulley having its rotational axis maintained stationary.

7. An assembly according to claim 4, wherein said transmission means comprises a driven gear connected to said center shaft, a drive gear having its rotational axis maintained stationary and maintained in meshing engagement with said driven gear, and an arm swingable about an axis parallel to the drive gear axis and having its free end connected to said center shaft.

8. An assembly according to claim 4, wherein said copying machine further comprises a tank detachably mounted adjacent said squeeze roller for containing a developing solution and wherein said assembly further comprises a rectangular flexible blade mounted at its bottom edge on said tank and having its top edge maintained in intimate contact with the peripheral surface of said squeeze roller, said blade having a top corner of one side thereof bevelled.

* * * * *